United States Patent [19]

Fulgoni

[11] Patent Number: 4,465,084

[45] Date of Patent: Aug. 14, 1984

[54] PROTECTIVE DEVICES FOR PERMANENTLY WAVING SOLELY IN THE VICINITY OF THE ROOT OF A HAIR

[76] Inventor: Jean-Claude Fulgoni, 16, avenue de Longchamps, 92210 Saint Cloud, France

[21] Appl. No.: 460,270

[22] Filed: Jan. 24, 1983

[30] Foreign Application Priority Data

Jan. 29, 1982 [FR] France ..... 82 01477

[51] Int. Cl.[3] ..... A45D 2/02

[52] U.S. Cl. ..... 132/39; 132/43 A

[58] Field of Search ..... 132/39, 43 A, 36, 43 R, 132/35, 36.2 R, 79 F

[56] References Cited

U.S. PATENT DOCUMENTS 4,258,733 3/1981 Fulgoni ..... 132/43 A

FOREIGN PATENT DOCUMENTS 85587 8/1983 European Pat. Off. ..... 132/43 A

*Primary Examiner*—Gregory E. McNeill

*Attorney, Agent, or Firm*—Larson and Taylor

[57] ABSTRACT

The invention relates to a protective device for permanent-waving a hair solely in the vicinity of the root thereof, comprising: a rigid or semi-rigid part (20) curved in the shape of a gutter; a flexible and impermeable sheet (21) firmly attached by one edge to said part (20); a second rigid or semi-rigid part (22) curved in the shape of a gutter and firmly attached to the opposite edge of the sheet (21) and carrying inwardly an absorbent part (23), the rigid part (22) having two resiliently deformable fastening clips (24) extending over an arc of a circle through at least 180°.

12 Claims, 5 Drawing Figures

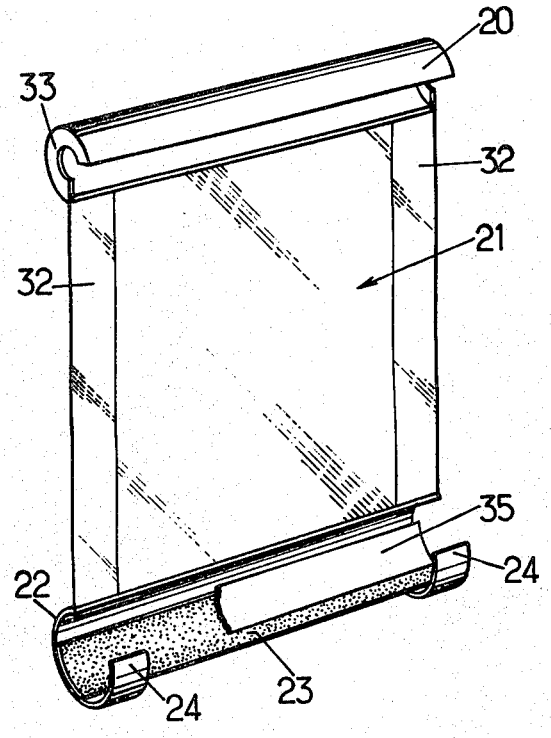
Fig.3.
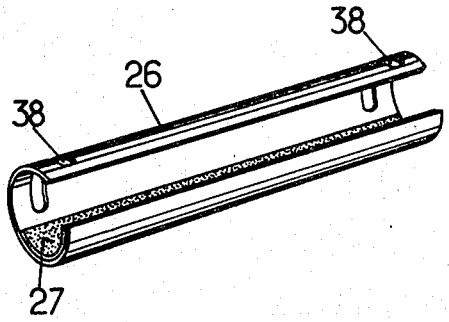
Fig.4.
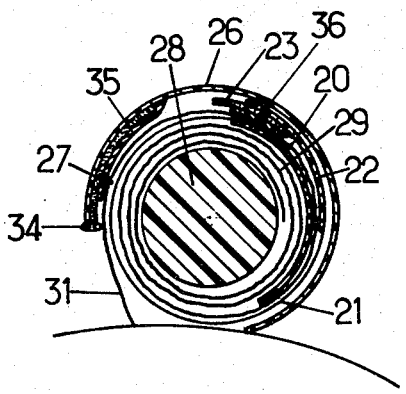
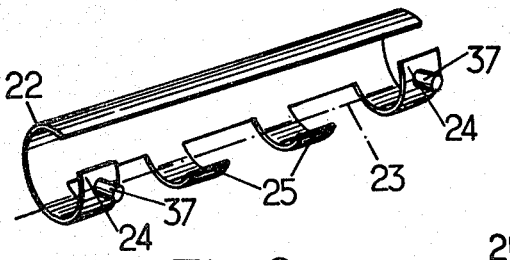
Fig.2.
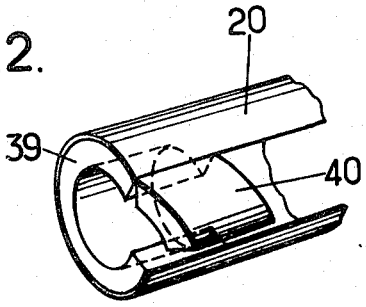
Fig.5.

PROTECTIVE DEVICES FOR PERMANENTLY WAVING SOLELY IN THE VICINITY OF THE ROOT OF A HAIR

The present invention relates to improvements to protective devices for permanently waving a hair solely in the vicinity of the root thereof and for protecting from the action of the permanent-wave product the part of the hair not situated in the vicinity of the root, these devices comprising:

a rigid or semi-rigid part having a curved gutter shape, a flexible and impermeable sheet substantially quadrangular in shape, a first edge of which is firmly attached to said rigid part, and an absorbent part, adapted to absorb the permanent-wave product, firmly attached to a second edge of the flexible sheet opposite said first edge.

Such a device is described for example in French patent application FR No. 78 22017 (published under No. 2 431 845).

The aim of the invention is essentially to improve these known protective devices principally so that they are better adapted to the different requirements of practice and so that they may in particular be used and positioned without requiring special precautions and attention from the user, while providing the desired effect, namely the protection of the untreated part of the hair against the action of the permanent-wave product.

To these ends, the improvements made in accordance with the invention consist in that, between the flexible sheet and the absorbent part, there is inserted a second rigid or semi-rigid part having a curved gutter shape firmly attached by one of its edges (first edge) to the flexible sheet and carrying the absorbent part firmly attached along its opposite edge (second edge), and in that the second rigid part has at or adjacent its two ends, respectively two fastening clips extending over an arc of a circle through at least 180° and formed from a resiliently deformable material.

With this arrangement, whatever the position of the absorbent part on the periphery of the hair-roller, once the protective device is rolled up with the hair in the functional position around the hair-roller, this absorbent part will be maintained applied against the hair and may play its role efficiently.

If need be, the contact between the absorbent part and the hair may be further improved by the fact that, between the two fastening clips, are provided holding fingers projecting from the second edge of the second ridge part and also formed from a resiliently deformable material. Thus, the absorbent part is maintained against the hair over the whole of its length and its efficiency is thus further improved.

Preferably, for reasons of simplicity of manufacture, the fastening clips and possibly the holding fingers are integrally formed with the second rigid part.

It is furthermore advantageous to provide a removable adjusting member in the form of a gutter extending over an arc of a circle through at least 180°, having along one of its longitudinal edges an absorbent part and being formed from a resiliently deformable material. With this member, the user no longer has to position the protective device accurately on the hair to be treated so as to leave only the exact length of the hair projecting in the vicinity of the root which is to be treated: he may now proceed to an approximate positioning of the protective device, then cover the assembly wound on the hair-roller by means of the adjusting member with the absorbent part thereof disposed towards the root of the hair, and finally rotate this member so as to bring the absorbent part to the exact position where the action of the permanent-wave product should stop; in other words he may, accurately and continuously, adjust the length of the part of the hair adjacent the root which is to be treated.

To facilitate the rotary movement of the adjusting member guide means may be advantageously provided which comprise at least two radial studs carried by the adjusting member or the fastening clips of the second rigid or semi-rigid part and at least two circumferentially elongate apertures adapted to receive said studs and carried respectively by the fastening clips on the adjusting member.

It is advantageous for the internal face of each absorbent part to be impermeable to the permanent-wave product in its rear part and to be only permeable in its front edge and/or in the vicinity of said edge. Thus, each absorbent part may be given a sufficient volume for the device to be efficient without however, despite the dimensions which result therefrom, the protected part of the hair being placed in contact with the absorbent part imbibed with the permanent-wave product.

Advantageously, the front edge of each absorbent part is enlarged to form a pad resiliently applied against the hair in the fitted position.

To avoid the need to select hair-rollers of different diameters depending on the position of the hair to be treated on the head, it is provided for the first rigid or semi-rigid part to have, in the region of its lateral ends, a thickness greater than that of its central zone and two curved lugs are provided, extending respectively the thickest zones, rotatably mounted on the rigid part so, in the fitted position, as to close the gap between the facing edges of the rigid part and to offer to the flexible sheet a continuous support in these end zones. Thus, by providing protective devices having rigid parts with lateral ends of different thicknesses (for example three different types in practice), it is possible to use a single type of hair-roller of given diameter, which considerably simplifies the work of the user who has only to match the protective devices with the hair-rollers of corresponding diameter.

To facilitate the positioning of the protective device on the hair-roller, the lateral edges of the first and/or of the second rigid or semi-rigid part may be provided with a continuous or discontinuous radial flange forming an axial stop in the fitted position of the hair-roller or else, according to a variation, the relatively more rigid zones may be situated along the lateral edges of the sheet, and the sheet may then present continuous or discontinuous lateral flanges forming an axial stop in the fitted position on the hair-roller.

The invention will be better understood from reading the following description of some of its embodiments, given solely by way of illustrative example and in which reference is made to the accompanying drawings in which:

FIG. 1 shows in a perspective view a protective device formed in accordance with the invention;

FIG. 2 shows, in a perspective view, another embodiment of a part of the device of FIG. 1;

FIG. 3 shows, in a perspective view, another element in accordance with the invention usable with the device of FIG. 1 or the variation of FIG. 2;

FIG. 4 illustrates, in cross section, the protective device of FIGS. 1 and 2 fitted in the functional position in association with the element of FIG. 3; and FIG. 5 shows another variation of a part of the device of FIG. 1.

Referring first of all to FIG. 1, the protective device of the invention comprises an elongate part 20 in the form of a gutter, curved over at least 180° so as to facilitate the initial positioning of the protective device on the hair-roller. This part 20 is formed from a resiliently deformable rigid or semi-rigid material, preferably a plastic material.

Along one longitudinal edge of part 20 is firmly attached a flexible protective sheet 21, impermeable to liquids and formed from a very flexible material having the property of lightly adhering to the bodies to which it is applied (for example polyvinyl chloride having a thickness of a few tens of microns—typically 10 to 20).

Although sheet 21 may be entirely flexible, it is however advantageous, to facilitate rolling thereof with the part of the hair to be protected, for it to have two lateral strips 32 which are substantially more rigid (see FIG. 1): this increased rigidity may be obtained either by bonding two reinforcing strips to sheet 21 or preferably by density differentiation of the material during manufacture of the sheet.

This sheet has a substantially rectangular shape and, along its edge opposite the one to which part 20 is attached, it is firmly attached to absorbent means adapted, when the protective device is in a functional position, so as to prevent the permanent-wave liquid from rising by capillarity along the hair.

These means comprise a second curved and elongate part 22 in the form of a gutter, firmly attached along one of its longitudinal edges to the flexible sheet 21 and provided, on its inner face and along its other longitudinal edge, with a strip 23 of absorbent material such as a synthetic foam.

At both its ends, gutter shaped part 22 is provided respectively with two extensions 24 curved along an arc of a circle through at least 180°. These extensions 24 form resiliently deformable clips adapted, in the functional position of the protective device on the hair-roller, to grip round the corresponding ends of the hair-roller: thus, the strip of absorbent material 23 is sure to remain applied against the hair and is in a position to play its role which is that of preventing the permanent-wave liquid deposited on the disengaged part of the hair adjacent the root, from rising by capillarity into the region of the hair which is not to be subjected to the action of this product.

FIG. 2 shows a variation of the arrangements provided in FIG. 1: between the extensions of ends 24, fingers 25 curved in the same direction as extensions 24 extend from the edge of the gutter shaped part 22, over a length which is however less than that of extension 24. Fingers 25, from one to three in number for example, contribute in maintaining the absorbent material strip 23 on the hair.

Extensions 24 and fingers 25 are integrally formed with gutter shaped part 22, which may be formed from any resiliently deformable material.

With these arrangements, the strip of absorbent material 23 is sure to remain applied to the hair whatever the position in which it is located, in the functional position, on the periphery of the hair-roller.

To facilitate the positioning of the device on the hair-roller and to maintain it axially thereon, axial stop means are provided formed by a radial flange either on elongate part 20 (as shown at 33 in FIG. 1) or on elongate part 22, or finally on the sheet 21 itself when it is provided with reinforcing strips 32.

FIG. 3 shows an adjusting member 26 formed by a sheet of resiliently deformable rigid or semi-rigid material curved into a gutter shape over an arc of a circle of at least 180°. A strip 27 of absorbent material is fixed to the inner face of this member, along one of its longitudinal edges.

As shown in FIG. 4, the part 29 to be protected of the hair is first of all wound around hair-roller 28 at the same time as the protecting device 20–24 is rolled on. Only a portion 31 of the hair projects between the root and the absorbent strip 23. Then member 26 is positioned while deforming it resiliently so that it grips round the assembly formed about hair-roller 28 so that its absorbing strip 27 is situated on the same side as the root of the hair. Then, by rotating the member in the appropriate direction and with the appropriate amplitude, it is possible to simply and accurately adjust the length of the hair remaining accessible for undergoing the action of the permanent-wave product. Thus, the user is not required to accurately position the protective device on the hair before it is rolled on the hair-roller; this positioning may be only approximative and the accuracy of adjustment is obtained by rotation of member 26.

To obtain a clear-cut transition between the part of the hair to be protected and the part to be treated, the front edge of the absorbent strip is arranged in the form of a projecting pad. Though such an arrangement may be considered for the absorbent strip 23 carried by the rigid part 22, it is especially advantageous for the absorbent strip 27 carried by the adjusting member 26: this pad is shown at 34 in FIG. 4.

To increase the protection of the part of the hair which does not have to be treated, the absorbent strips 23 and/or 27 are made partially impermeable, on their inner face, for example by addition of an impermeable sheet 35 for absorbent strip 23 (FIGS. 1 and 4) and/or 36 for the absorbent strip 27 (FIG. 4) only leaving free the front edge of these absorbent strips. Thus, once it is imbibed with the permanent-wave product, each of these absorbent strips is prevented from coming into contact with the part of the hair which does not have to be treated.

To facilitate the rotational movement of the adjusting member 26 and allow accurate angular positioning thereof, a guide system is provided comprising for example, as shown in FIGS. 2 and 3, two studs 37 projecting radially from the external face of extensions 24 and two elongate apertures 38 extending along the circumference of the adjusting member 26.

Finally, as shown in FIG. 5, the rigid or semi-rigid part 20 is equipped, in the vicinity of its ends, with curvilinear wedges 39 having circumferentially the same contour as part 20. These wedges have an open curvilinear shape so as to allow positioning of part 20 on the hair-roller and a mobile portion 40, hingedly connected for rotation, may be pressed down so as to obtain a wedge presenting a closed contour offering continuous circumferential support for the winding of sheet 21. By having available several (for example three of four) types of protective devices whose rigid or semi-rigid parts 20 are equipped with curvilinear wedges of different thicknesses, the hair may be rolled on different diameters while using only a single type of hair-roller. The result is a simplification of the work of the user.

As is evident and as it follows moreover already from what has gone before, the invention is in no wise limited to those of its modes of application and embodiments which have been more especially considered; it embraces, on the contrary, all variations thereof.

I claim:

1. A protective device for permanently waving a hair solely in the vicinity of the root thereof and for protecting from the action of the permanent-wave product the part of the hair not situated in the vicinity of the root, comprising:

a rigid or semi-rigid part (20) having a curved gutter shape, a flexible and impermeable sheet (21) substantially quadrangular in shape, a first edge of which is firmly attached to said rigid part, and an absorbent part (23) adapted to absorb the permanent-wave product, firmly attached to a second edge of the flexible sheet opposite said first edge, characterized in that between the flexible sheet (21) and the absorbent part (23) there is inserted a second rigid or semi-rigid part (22) having a curved gutter shape firmly attached by one of its edges (first edge) to the flexible sheet and carrying, firmly attached along its opposite edge (second edge), the absorbent part (23), and in that the second rigid part (22) has, at or in the region of its two lateral ends, respectively two fastening clips (24) extending over an arc of a circle through at least 180° and formed from a resiliently deformable material.

2. The protective device according to claim 1, characterized in that, between the two fastening clips (24), are provided holding fingers (25) projecting from the second edge of the second rigid part and also formed from a resiliently deformable material.

3. The protective device according to claim 1, characterized in that the absorbent part (23) is firmly attached to the second rigid part along the second edge thereof so that it projects substantially from said second edge.

4. The protective device according to claim 1, characterized in that the two fastening clips (24) and possibly the holding fingers (25) are integrally formed with the second rigid part.

5. The protective device according to claim 1, characterized in that it further comprises an adjusting member (26) in the form of a gutter extending over an arc of a circle through at least 180°, having along one of its edges an absorbent part (27) and being formed a resiliently deformable material, this member being, in the fitted position, adapted to rotate about its axis so as to bring its absorbent part (27) into a given angular position with respect to the hair.

6. The protective device according to claim 5, characterized in that guide means are provided for guiding the rotational movement of the adjusting member, these guide means comprising at least two radial studs carried by the adjusting member or the fastening clips of the second rigid or semi-rigid part and at least two circumferentially elongate apertures adapted to receive said studs and carried respectively by the fastening clips or the adjusting member.

7. The protective device according to claim 1, characterized in that the internal face of each absorbing part (23,27) is impermeable to the permanent-wave product in its rear part and is only permeable in its front edge and/or in the vicinity of said edge.

8. The protective device according to claim 7, characterized in that the front edge of each absorbent part (23,27) is enlarged to form a pad resiliently applied, in the fitted position, against the hair.

9. The protective device according to claim 1, characterized in that the first rigid or semi-rigid part (20) has, in the region of its lateral ends, a thickness greater than that of its central zone and that it is provided with two curved lugs, extending respectively the thickest zones, rotatably mounted on the rigid part so, in the fitted position, as to close the gap between the facing edges of the rigid part and to offer to the flexible sheet a continuous support in these end zones.

10. The protective device according to claim 1, characterized in that the flexible sheet has along its two lateral edges, or in the immediate vicinity of said edges, respectively two strip shaped zones having greater rigidity.

11. The protective device according to claim 1, characterized in that the lateral edges of the first and/or of the second rigid or semi-rigid part are provided with a continuous or discontinuous radial flange forming an axial stop in the fitted position on the hair-roller.

12. The protective device according to claim 10, characterized in that the relatively more rigid zones are situated along two lateral edges of the sheet and in that the sheet then has continuous or discontinuous lateral flanges forming an axial stop in the fitted position on the hair-roller.

* * * * *